US005277593A

United States Patent [19]

Bates et al.

[11] Patent Number: 5,277,593

[45] Date of Patent: Jan. 11, 1994

[54] COMPRESSIBLE ELECTRICAL CONNECTORS FOR LARGE BOARD SPACINGS

[75] Inventors: Warren A. Bates, Winston Salem; Frederick R. Deak, Kernersville; David C. Johnson, Winston Salem; Robert M. Renn, Pfafftown, all of N.C.; Douglas M. Walburn, Harrisburg, Pa.; Keith L. Volz, Jamestown, N.C.

[73] Assignee: The Whitaker Corporation, Wilmington, Del.

[21] Appl. No.: 954,173

[22] Filed: Sep. 30, 1992

[51] Int. Cl.[5] ..... H01R 9/09

[52] U.S. Cl. ..... 439/66; 439/67; 439/77; 439/493; 439/591

[58] Field of Search ..... 439/66, 67, 77, 492, 439/493, 591

[56] References Cited

U.S. PATENT DOCUMENTS 3,173,732 3/1965 James ..... 439/66
4,173,381 11/1979 Allmark et al. ..... 439/66
4,693,530 9/1987 Stillie et al. ..... 439/67

*Primary Examiner*—Paula A. Bradley
*Attorney, Agent, or Firm*—William B. Noll

[57] ABSTRACT

A compressible electrical connector (10) includes a rigid molded body (11) having elastomeric caps (19, 20) at the top (12) and bottom (13) thereof. A thin flexible film (21), provided with respective connector elements (22), is wrapped around the rigid molded body (11) and its caps (19, 20) and is retained by a film retaining plate (23). The film retaining plate (23) has a plurality of latching lances (24) received in corresponding mounting holes (30) formed transversely in the rigid molded body (11). A hot melt layer (36) is placed over the film retaining plate (23), and a plurality of compressible electrical connectors (10) are stacked side-by-side to form an array (35). The array (35) is disposed between a pair of PC boards or other electronic assemblies (39, 40) having respective circuit elements (37, 38). The height of the rigid molded body may be changed conveniently to readily accommodate different product applications.

4 Claims, 6 Drawing Sheets

COMPRESSIBLE ELECTRICAL CONNECTORS FOR LARGE BOARD SPACINGS

The present invention relates to flexible or compressible electrical connectors used for electrically connecting the respective circuit elements on printed circuit ("PC") boards or other electronic assemblies, and more particularly, to large board spacings in different product applications.

BACKGROUND OF THE INVENTION

Compressible electrical connectors are well known in the computer, electronics and aerospace industries. These compressible electrical connectors comprise a plurality of wires or traces photographically etched or otherwise formed on a thin flexible film. The film is then wrapped around a core which may be formed from a suitable elastomeric material. There are a wide variety of such molded compressible electrical connectors supplied by AMP Incorporated of Harrisburg, Pa. under its trademark "AMPLIFLEX".

In a typical product application, one or more "AMPLIFLEX" compressible electrical connectors are disposed between a respective pair of PC boards, thereby making the desired electrical connection between the respective circuit elements on the boards. As the boards are clamped together, the elastomeric core of the compressible electrical connector is compressed.

However, the equipment often requires a relatively large spacing (or height) between the respective boards, as for example, 0.400 inches (or roughly 10 mm.). As a result, the compressible electrical connector may become bowed or distorted, thereby compromising the structural integrity and electrical continuity of the overall assembly. Moreover, the equipment manufacturers often require loose or "sloppy" tolerances in the spacings between the PC boards.

Therefore, it would be very desirable to accommodate these relatively large spacings and wide tolerance ranges without incurring engineering and production problems resulting in increased costs. The cost of the elastomeric material, itself, is also an important factor to be considered.

SUMMARY OF THE INVENTION

By providing a modular concept for a variety of product applications, in which compressible electrical connectors are clamped between PC boards, the present invention accommodates large spacings between the boards as well as relatively wide tolerances, thereby alleviating engineering and production problems, expediting customer deliveries, and reducing manufacturing costs.

In accordance with the teachings of the present invention, there is disclosed a preferred embodiment of a compressible electrical connector, including a rigid molded body having respective top, bottom and side surfaces. A pair of elastomeric caps are carried by the respective top and bottom surfaces of the rigid molded body. A thin flexible film is wrapped around the pair of elastomeric caps and around the respective side surfaces of the rigid molded body, and means are provided for retaining the flexible film to the rigid molded body. The flexible film has respective connector means thereon (comprising the photographically-etched wires or their equivalent) to interconnect respective circuit elements on a pair of PC boards.

The rigid molded body assures structural integrity of the compressible electrical connector while reducing overall costs. In turn, the elastomeric caps exert a substantially-constant resilient bias, provide a "cushion" for the thin flexible film, and take up tolerance accumulations between the PC boards. This construction facilitates a stacked array of adjacent connector subassemblies.

Another body may be molded conveniently for a different product application, thereby providing manufacturing flexibility, lowering cycle times in product development, and reducing costs.

In a preferred embodiment, the rigid molded body is elongated and the respective elastomeric caps comprise molded strips of silicone rubber.

In accordance with the further teachings of the present invention, the rigid molded body includes a pair of telescoped sections having cooperating ratcheting means for incremental height adjustment from a maximum to a minimum in a given range.

Preferably, the means for retaining the flexible film to the rigid molded body includes a film retaining plate provided with at least one latching lance formed thereon and snapped on to the rigid molded body.

DETAILED DESCRIPTION OF THE PREFERRED EMBODIMENT

Figure 1:
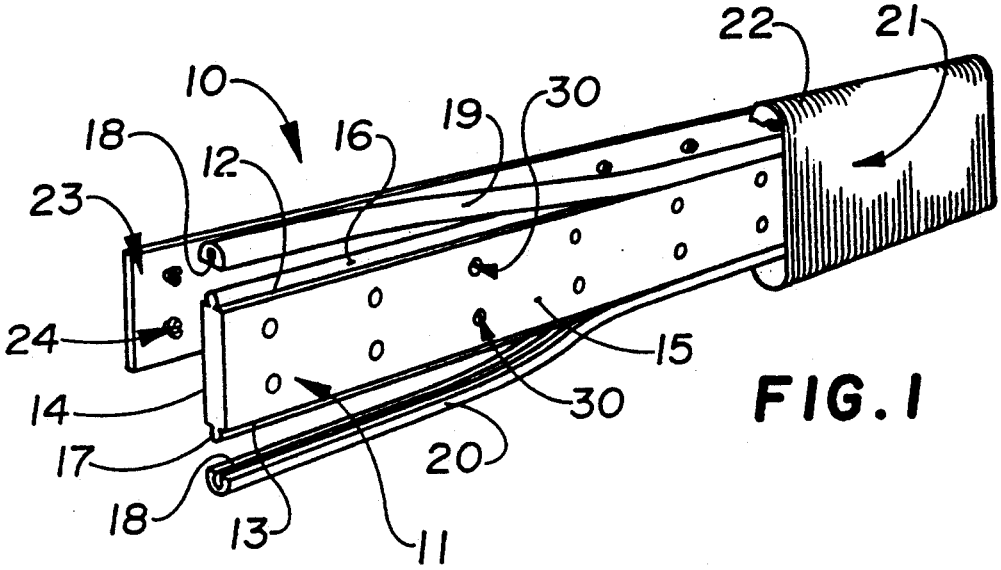
FIG. 1 is an exploded perspective of the rigid molded body, the elastomeric caps carried on the top and bottom thereof, the thin flexible film, and the film retaining plate.
Figure 2:
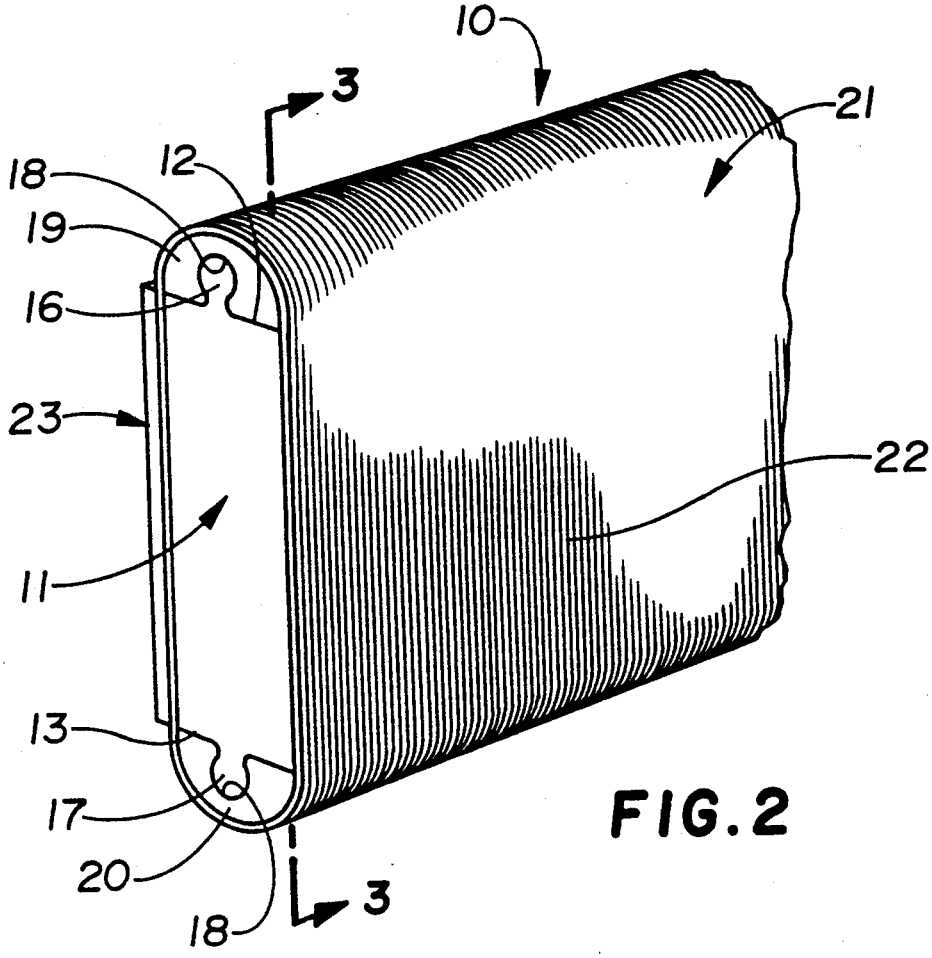
FIG. 2 is a perspective of the components of FIG. 1 in their assembled relationship.
Figure 3:
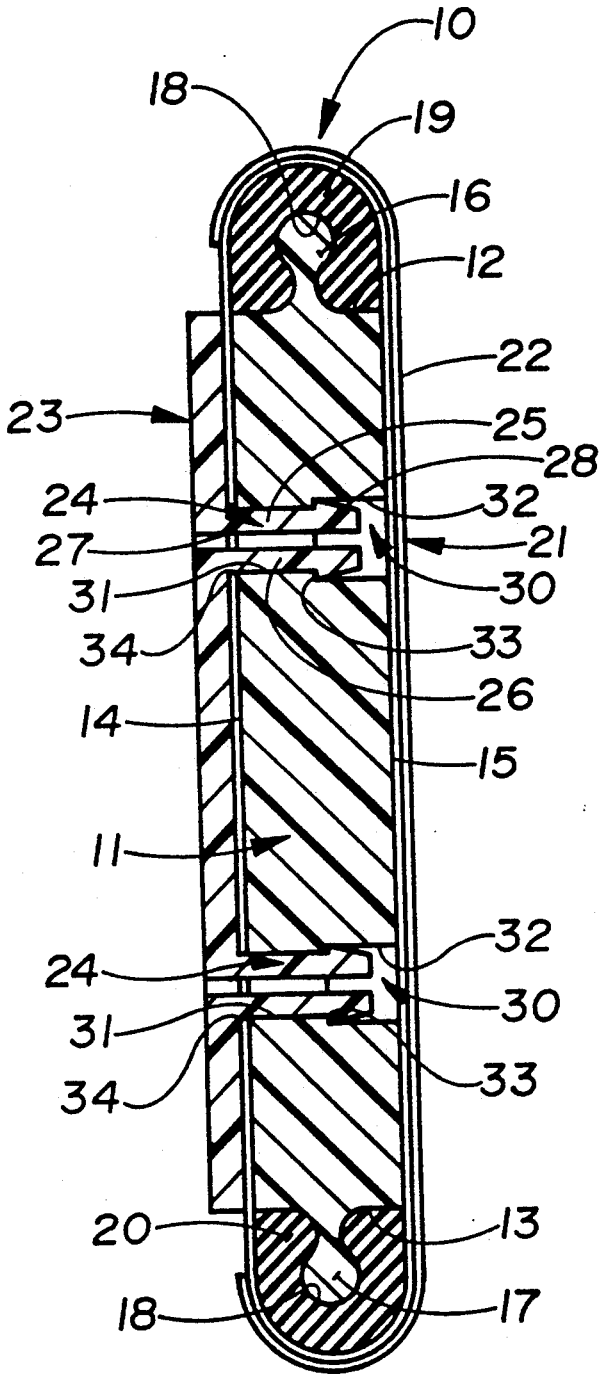
FIG. 3 is a section view, taken across the lines 3—3 of FIG. 2, and drawn to an enlarged scale.

With reference to FIGS. 1–3, the compressible electrical connector 10 includes an elongated rigid molded body 11 having a top surface 12, a bottom surface 13, and respective side surfaces 14 and 15. The top and bottom surfaces 12, 13 have respective elongated protrusions 16 and 17, respectively, which are rounded off and are received within corresponding elongated slots 18 in elongated caps 19 and 20, respectively, thereby mounting the caps 19, 20 on to the molded body 11.

The rigid molded body 11 is molded from any suitable material, such as a liquid crystal polymer. The elastomeric caps 19, 20 are molded from a suitable silicone rubber compound having a high temperature and low compression set.

A thin flexible film 21, having a plurality of individual wires or traces 22, is wrapped around the respective side surfaces 14, 15 of the rigid molded body 11 (and around the top and bottom elastomeric caps 19, 20) and is secured to the rigid molded body 11 by a film retaining plate 23. This film retaining plate 23 is a molded elongated strip having a plurality of integrally-molded latching lances 24 projecting laterally therefrom.

Figure 6:
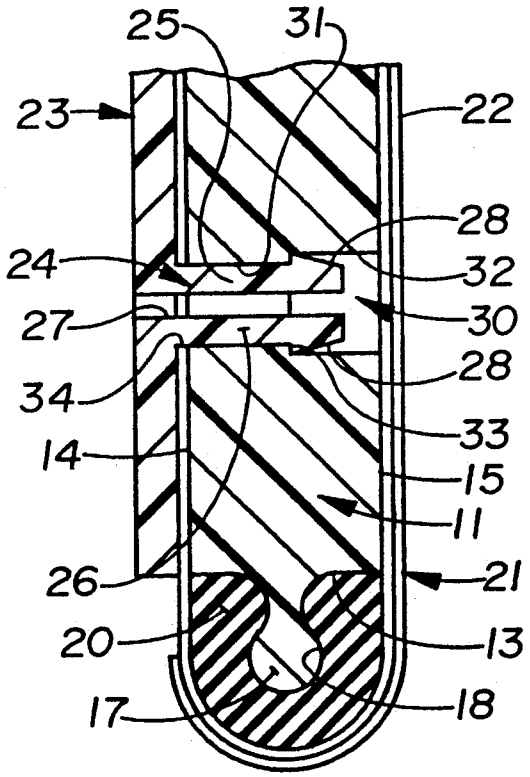
FIG. 6 corresponds to FIG. 5, but shows the film retaining plate snapped into the rigid molded body.
Figure 5:
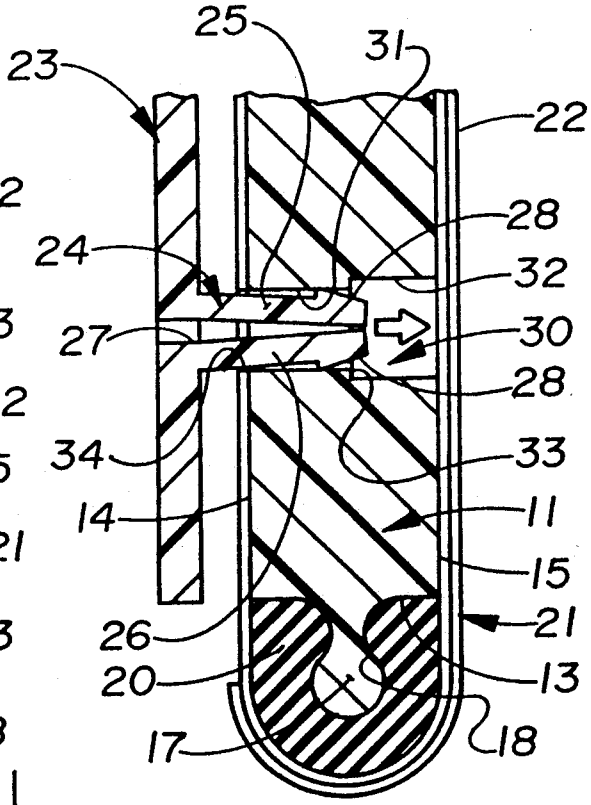
FIG. 5 corresponds to FIG. 4, but shows the bifurcated legs of one of the latching lances being inserted into its corresponding mounting hole in the rigid molded body.
Figure 4:
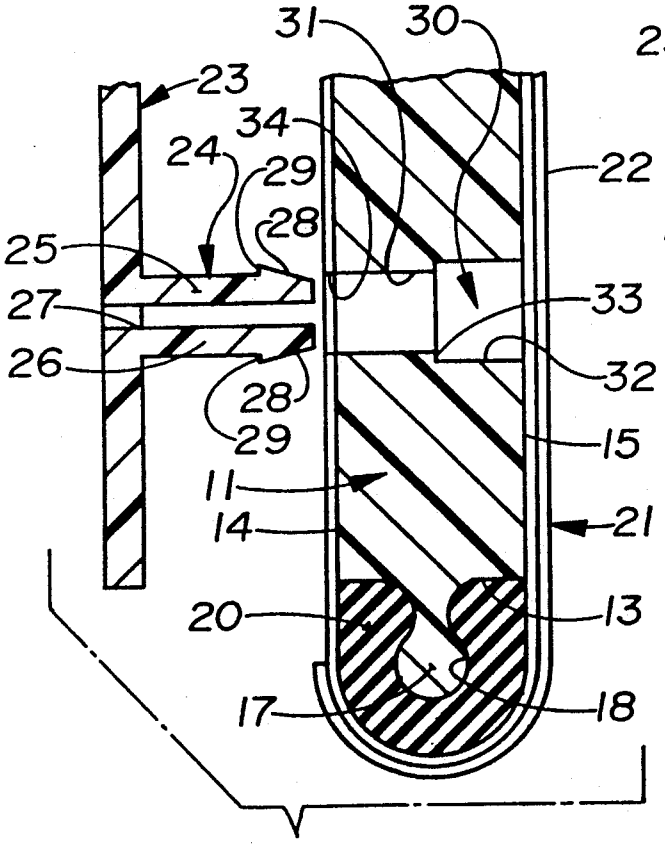
FIG. 4 corresponds to a portion of FIG. 3, drawn to an enlarged scale, and showing the film retaining plate in exploded relationship to the rigid molded body.

With further reference to FIGS. 4–6, each latching lance 24 on the film retaining plate 23 has a pair of bifurcated legs 25 and 26, respectively, defining an opening 27 therebetween. Each leg 25, 26 has an enlarged forward portion including an inclined or tapered surface 28 and further including an undercut 29. The rigid molded body 11 has a corresponding plurality of spaced-apart mounting holes 30 formed transversely therein. Each mounting hole 30 has a bore 31 and a counterbore 32, thereby defining a ledge 33 in the mounting hole 30.

As the latching lance 24 is received in its respective mounting hole 30, as shown more clearly in the sequence views of FIGS. 4–6, the inclined surfaces 28 engage the circular edge or periphery of the mounting hole 30, thereby causing the respective bifurcated legs 25, 26 on the latching lance 24 to be cammed inwardly and squeezed together (FIG. 5). Thereafter, the undercuts 29 on the respective bifurcated legs 25, 26 engage the ledge 33 in the mounting hole 30 (FIG. 6) as the film retaining plate 23 is snapped into the rigid molded body 11, thereby retaining the thin flexible film 21. The thin flexible film 21 has a plurality of openings 34 to accommodate passage of the latching lances 24 into their respective mounting holes 30.

Figure 7:
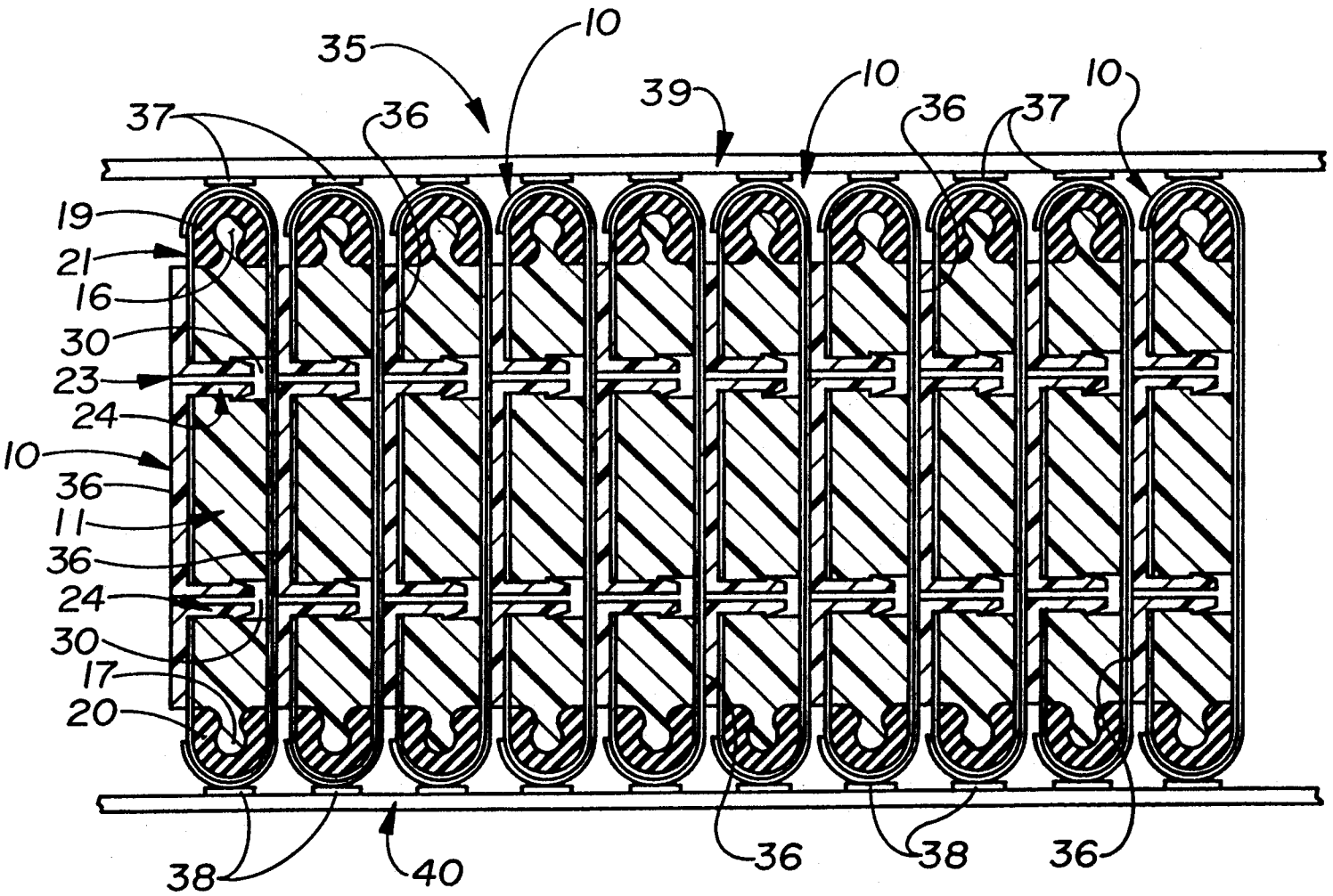
FIG. 7 is a section view showing a stacked array of the compressible electrical connectors of FIG. 3.

With reference to FIG. 7, a plurality of compressible electrical connectors 10 may be stacked side-by-side adjacent to each other to form an overall array 35. A hot melt layer 36 is placed on the exterior of each film retaining plate 23 to adhesively secure each compressible electrical connector 10 to its adjacent compressible electrical connector 10. The array 35 provides electrical connection between respective circuit elements 37, 38 on respective electronic assemblies 39 and 40, respectively, shown schematically in FIG. 7.

Figures 8, 9, 10:
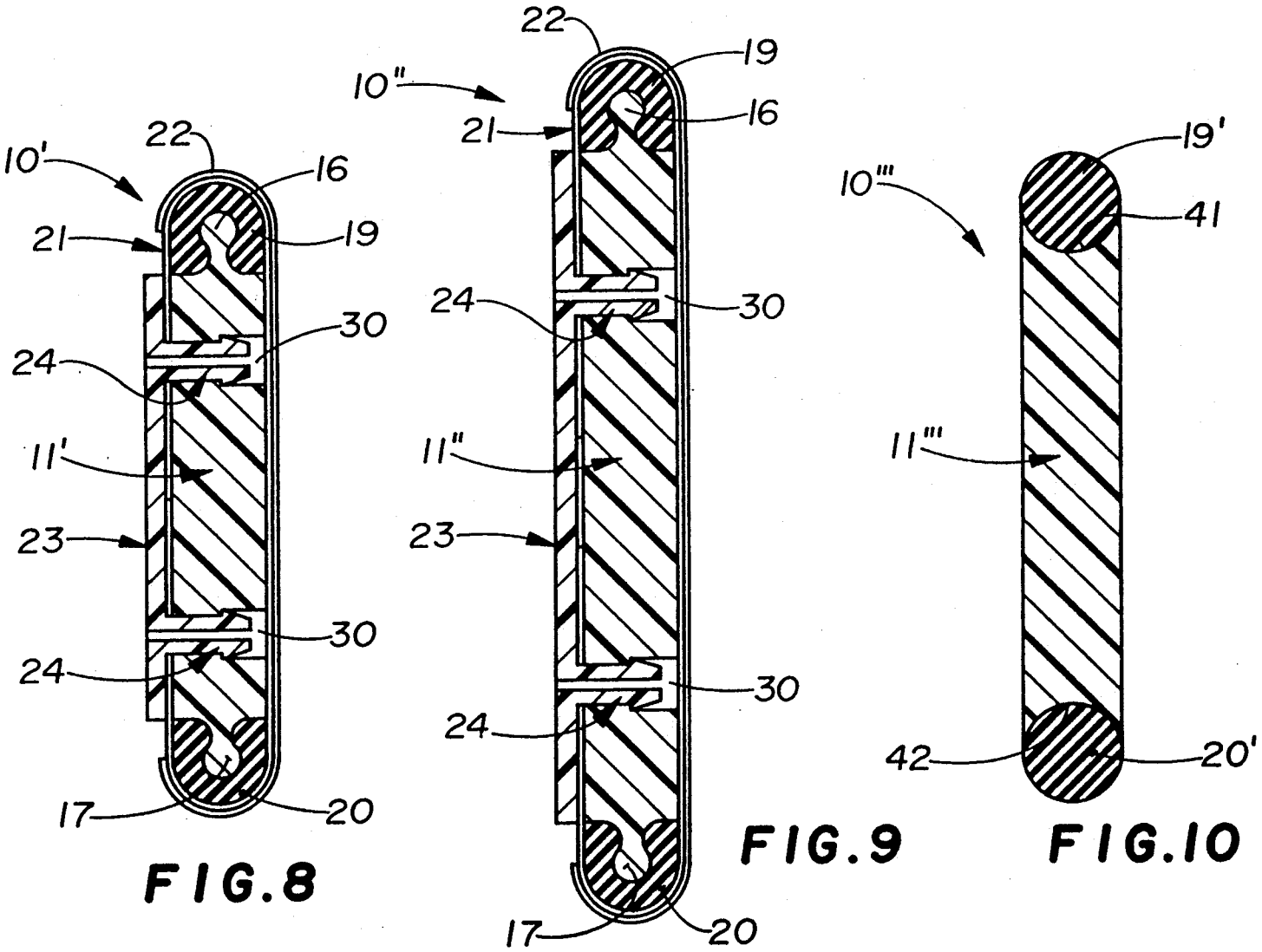
FIG. 8 is a section view, corresponding substantially to FIG. 3, but showing a compressible electrical connector with a shorter height.
FIG. 9 is a section view, corresponding substantially to FIG. 3, but showing a compressible electrical connector with a higher height.
FIG. 10 is a section view of an alternate embodiment, wherein the elastomeric rubber caps have a completely round cross section.

The height of the rigid molded body 11 may be changed relatively easily in production to accommodate different product applications required by customers. As shown in FIG. 8, the molded body 11' has a shorter height; and in FIG. 9, the molded body 11'' has a higher height.

With reference to FIG. 10, an alternate embodiment of an electrical connector 10''' is illustrated, wherein the elastomeric caps 19' and 20' have substantially circular cross-sections and are received in corresponding semicircular recesses 41 and 42, respectively, formed at the top and bottom of a molded body 11'''.

Figure 13:
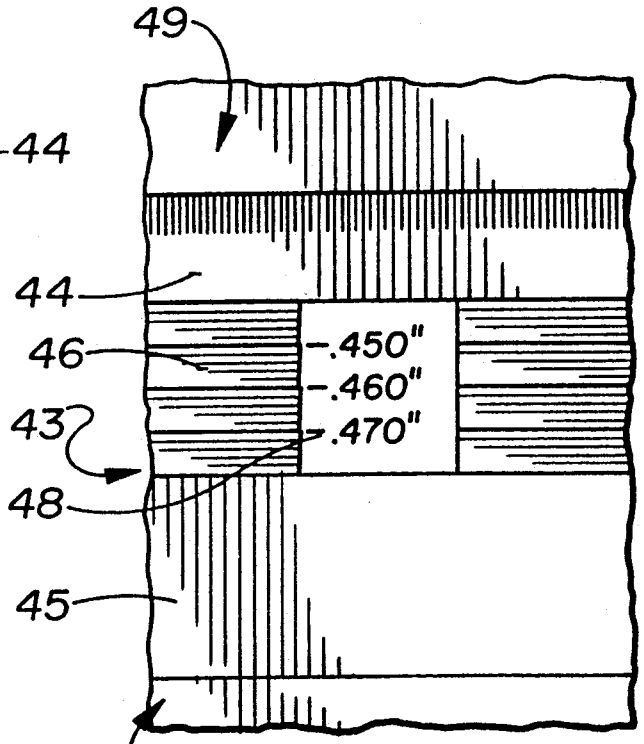
FIG. 13 is a side elevation of a portion of the rigid molded body of FIG. 11, showing graduations on the side thereof to assist the user in adjusting the height of the connector assembly, incrementally, from a maximum height to a minimum height within a given range.
Figure 12:
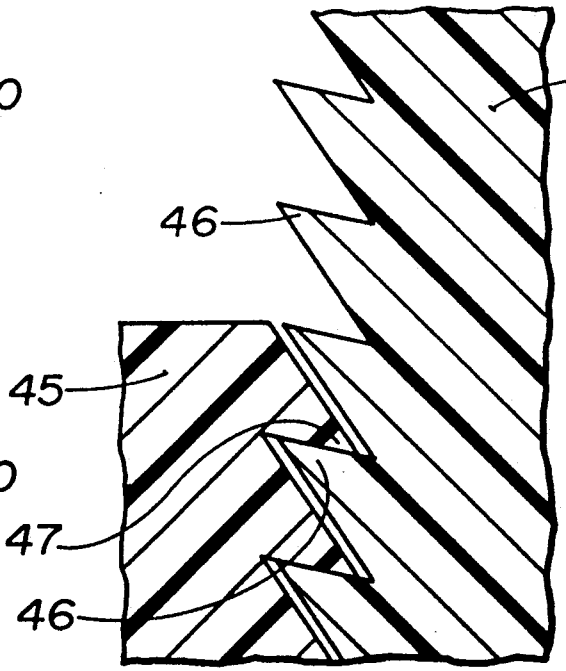
FIG. 12 is a portion of FIG. 11, drawn to an enlarged scale, and showing the cooperating ratcheting projections between the telescoped sections of the rigid molded body.
Figure 11:
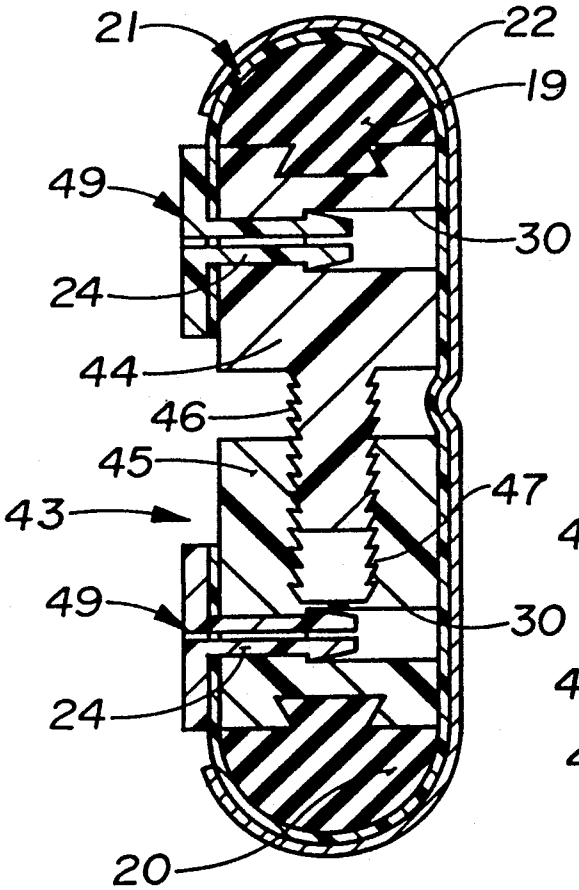
FIG. 11 is another alternate embodiment of the invention, wherein the rigid molded body includes a pair of sections telescoped with respect to each and having a one-way ratcheting means therebetween to rapidly adjust the height of the body within a given range from a maximum to a minimum height.

With reference to FIGS. 11–13, a rigid molded body 43 has a pair of telescoped sections 44 and 45. Each of the telescoped sections 44, 45 has a plurality of spaced-apart projections 46 and 47, respectively, to provide a "one-way" ratcheting action therebetween. The projections 46 and 47 slide over and partially deform or deflect each other in making a height adjustment in the rigid molded body 43. As a result, the height of the compressible electrical connector may be adjusted, incrementally, from a maximum to a minimum height in a given range. For example, the incremental height adjustments may be in the order of 0.010 inch, as shown in FIG. 13; and graduations 48 may be molded on one of the sections (such as section 45) to show the range. Separate retainers 49 may be used, as shown in FIG. 11, if desired.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A plurality of compressible electrical connectors between a plurality of electrical assemblies having respective circuit elements thereon, comprising:

a plurality of rigid molded elongated bodies having respective top, bottom and side surfaces, the rigid molded elongated bodies being stacked side-by-side and adjacent to each other to form an array, a pair of elastomeric strips carried by the respective top and bottom surfaces on each of the rigid molded elongated bodies, a flexible film wrapped around the respective pair of elastomeric strips and the respective side surfaces on each of the rigid molded elongated bodies, each of the flexible films having respective means thereon to electrically connect the respective circuit elements on the plurality of electrical assemblies, a film retaining plate secured to a respective side surface on each of the rigid molded elongated bodies, thereby retaining the flexible film to the respective rigid molded elongated body, and a hot melt layer over each film retaining plate and disposed between the respective retaining plate and the flexible film on the adjacent rigid molded elongated body.

2. A compressible electrical connector comprising:

a rigid molded body having respective top, bottom and side surfaces, where said respective top and bottom surfaces have respective protuberances formed thereon, a pair of elastomeric caps carried by the respective top and bottom surfaces of the molded body, where said elastomeric caps have respective dovetailed slots formed therein to receive the respective protuberances, a flexible film wrapped around the pair of elastomeric caps and the respective side surfaces of the molded body, the flexible film having respective circuit elements thereon, and means for retaining the flexible film to the molded body.

3. A compressible electrical connector, comprising:

a rigid molded body having respective top, bottom and side surfaces, a pair of elastomeric caps carried by the respective top and bottom surfaces of the molded body, a flexible film wrapped around the pair of elastomeric caps and the respective side surfaces of the molded body, the flexible film having respective circuit elements thereon, and means for retaining the flexible film to the molded body, said means comprising a film retaining plate provided with at least one latching lance thereon, the latching lance including a pair of bifurcated legs having respective inclined surfaces and further having respective undercuts, the rigid molded body having at least one mounting hole, the mounting hole having a ledge formed therein, and the flexible film having an opening formed therein in alignment with the latching lance and the mounting hole, respectively, whereby the latching lance is received through the opening in the flexible film and into the mounting hole in the rigid molded body, such that the inclined surfaces on the bifurcated legs of the latching lance engage the mounting hole and are cammed inwardly, and such that the bifurcated legs clear the mounting hole and are then released to their normal position, such that the respective undercuts on the bifurcated legs engage the respective ledges on the mounting hole in the rigid molded body.

4. A compressible electrical connector, comprising:

a rigid molded body having respective top, bottom and side surfaces, said rigid molded body further including a pair of telescoped sections having respective spaced-apart projections providing a one-way ratcheting action therebetween, where the height of the rigid molded body may be adjusted from a maximum to a minimum height in a given range, a pair of elastomeric caps carried by the respective top and bottom surfaces of the molded body, a flexible film wrapped around the pair of elastomeric caps and the respective side surfaces of the molded body, the flexible film having respective circuit elements thereon, and means for retaining the flexible film to the molded body.

* * * * *